US008230969B2

(12) United States Patent
Frederick et al.

(10) Patent No.: US 8,230,969 B2
(45) Date of Patent: Jul. 31, 2012

(54) ACOUSTIC PANELS, APPARATUS AND ASSEMBLIES WITH AIRFLOW-RESISTIVE LAYERS ATTACHED TO SOUND INCIDENT SURFACES

(75) Inventors: Mark Frederick, Shoreview, MN (US); Michael L. Dinsmore, Troy, MI (US); James Check, Armada, MI (US); Richard James Bliton, Greensboro, NC (US)

(73) Assignees: Precision Fabrics Group, Inc., Greensboro, NC (US); Pinta Acoustic, Inc., Minneapolis, MN (US)

( * ) Notice: Subject to any disclaimer, the term of this patent is extended or adjusted under 35 U.S.C. 154(b) by 0 days.

(21) Appl. No.: 13/091,476

(22) Filed: Apr. 21, 2011

(65) Prior Publication Data

US 2011/0284319 A1 Nov. 24, 2011

Related U.S. Application Data

(60) Provisional application No. 61/345,857, filed on May 18, 2010.

(51) Int. Cl.
*E04B 1/82* (2006.01)

(52) U.S. Cl. ..... 181/293; 181/290; 181/284; 181/292

(58) Field of Classification Search ..... 181/284, 181/290, 292, 293; 52/144, 145
See application file for complete search history.

(56) References Cited

U.S. PATENT DOCUMENTS

| | | | | |
|---|---|---|---|---|
| 4,084,367 | A * | 4/1978 | Saylor et al. | 428/113 |
| 4,477,505 | A * | 10/1984 | Warnaka | 428/160 |
| 5,041,323 | A * | 8/1991 | Rose et al. | 428/116 |
| 5,317,113 | A * | 5/1994 | Duda | 181/285 |
| 6,371,242 | B1 * | 4/2002 | Wilson et al. | 181/292 |
| 6,443,257 | B1 * | 9/2002 | Wiker et al. | 181/290 |
| 2003/0098200 | A1 * | 5/2003 | Clark | 181/292 |
| 2005/0006173 | A1 * | 1/2005 | Albin | 181/290 |
| 2006/0289230 | A1 * | 12/2006 | Connelly et al. | 181/290 |
| 2008/0073146 | A1 * | 3/2008 | Thompson et al. | 181/291 |
| 2009/0173570 | A1 * | 7/2009 | Levit et al. | 181/286 |

* cited by examiner

*Primary Examiner* — Forrest M Phillips
(74) *Attorney, Agent, or Firm* — Myers Bigel Sibley & Sajovec, P.A.

(57) ABSTRACT

An acoustic panel includes a main body portion having a substantially planar front surface for orientation toward a sound source and an opposite, substantially convoluted rear surface. An airflow-resistive layer of material is secured to the planar front surface in face-to-face contacting relationship. The airflow-resistive layer of material may have a specific airflow resistance of between about 50-20,000 mks rayls, and may be configured to attenuate sound at one or more predetermined frequencies. A depth of convolution of the rear surface is between about forty percent to about seventy-five percent (40%-75%) of a thickness of the main body portion.

19 Claims, 5 Drawing Sheets

ACOUSTIC PANELS, APPARATUS AND ASSEMBLIES WITH AIRFLOW-RESISTIVE LAYERS ATTACHED TO SOUND INCIDENT SURFACES

RELATED APPLICATION

This application claims the benefit of and priority to U.S. Provisional Patent Application No. 61/345,857 filed May 18, 2010, the disclosure of which is incorporated herein by reference as if set forth in its entirety.

FIELD OF THE INVENTION

The present invention relates generally to sound attenuation and, more particularly, to acoustic panels, apparatus and assemblies for attenuating sound.

BACKGROUND

Acoustic panels are utilized to change the acoustic qualities of a space, such as a room, studio, theater, stadium, etc. A wide variety of acoustic-affecting materials, such as acoustic absorbers are employed. A conventional acoustic panel 10, commonly used in recording studios, home theaters, concert halls, churches, offices, factories, etc., to reduce the amount of reverberant (reflected) sound energy and thereby improve the recording and/or listening environment, is illustrated in FIG. 1. The illustrated acoustic panel 10 has a main body portion 12 with a front face 14 and an opposite rear face 16. The front face 14 has an irregular or convoluted shape and is the surface that is designed to face a sound source within a space, such as a musical instrument within a room in which the acoustic panel 10 is being used. The rear surface 16 has a planar configuration that facilitates mounting the acoustic panel 10 to a wall or ceiling. Advantages of conventional acoustic panels with convoluted surfaces, such as illustrated in FIG. 1, include weight reduction and improved random incidence sound absorption performance.

It is known that improved sound absorption performance can be achieved by applying a semi-permeable, airflow-resistive facing to the planar surface of a conventional non-convoluted acoustic panel that is exposed to a sound source. For planar sound absorber surfaces, lamination of such a facing material to the acoustic panel is typically achieved using conventional adhesive systems or bonding technologies. The improvements in sound absorption performance for these planar, non-convoluted panels can range up to 100% or more at some frequencies. Unfortunately, it is not practical to attach a facing layer of material to acoustic panel surfaces with irregular or convoluted shapes, such as the front surface 14 of the acoustic panel 10 illustrated in FIG. 1.

In addition, it is known that an airflow-resistive facing applied to the rear planar surface of a conventional acoustic panel, such as the rear surface 16 of the acoustic panel 10 illustrated in FIG. 1, wherein the airflow-resistive facing is positioned against a mounting surface, such as a wall or ceiling, is ineffective in improving sound absorption performance because of the close proximity of the facing to an impermeable reflective surface. The close proximity inhibits the oscillatory flow of sound pressure waves through the facing, which in turn limits the viscous loss of acoustical energy by this action. As such, conventional acoustic panels with a convoluted surface do not incorporate airflow-resistive materials to either side thereof.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the invention.

According to some embodiments of the present invention, an acoustic panel includes a main body portion having a substantially planar front surface for orientation toward a sound source and an opposite, substantially convoluted rear surface. An airflow-resistive layer of material is secured to the planar front surface in face-to-face contacting relationship. The airflow-resistive layer of material may have a specific airflow resistance of between about 50-20,000 mks rayls, and may be configured to attenuate sound at one or more predetermined frequencies. In some embodiments, a depth of convolution of the rear surface is between about forty percent to about seventy-five percent (40%-75%) of a thickness of the main body portion.

According to some embodiments of the present invention, an acoustic apparatus includes a main body portion of compressible foam having a front surface for orientation toward a sound source and an opposite rear surface. The front surface is substantially planar, and the rear surface is substantially convoluted. The front surface includes a skin formed therein that is configured to attenuate sound at one or more predetermined frequencies.

According to some embodiments of the present invention, an acoustic panel assembly includes first and second main body portions with a septum sandwiched therebetween. The first main body portion has a substantially planar front surface for orientation toward a sound source and an opposite, substantially convoluted rear surface. A first airflow-resistive layer of material is secured to the front surface of the first main body portion in face-to-face contacting relationship. The second main body portion has a substantially planar front surface for orientation toward a sound source and an opposite, substantially convoluted rear surface. A second airflow-resistive layer of material is secured to the front surface of the second main body portion in face-to-face contacting relationship. The septum is sandwiched between the first and second main body portions such that the rear surfaces of the first and second main body portions are in contacting relationship with the septum. The septum may comprise paperboard, plastic, aluminum, steel, etc. The airflow-resistive layers of material may have a specific airflow resistance of between about 50-20,000 mks rayls, and may be configured to attenuate sound at one or more predetermined frequencies.

According to some embodiments of the present invention, an acoustic panel is provided in combination with a structure having a sound reflective surface, such as a wall or ceiling. The acoustic panel has a main body portion with a planar front surface for orientation toward a sound source and an opposite rear surface that is substantially convoluted and that is in contacting relationship with the sound reflective surface. An airflow-resistive layer of material is secured to the front surface in face-to-face contacting relationship.

According to some embodiments of the present invention, an acoustic apparatus is provided in combination with an article having a sound reflective surface. The acoustic apparatus includes a main body portion having a front surface for orientation toward a sound source and an opposite substantially convoluted rear surface that contacts the sound reflective surface. An airflow-resistive layer of material is secured to the front surface in face-to-face contacting relationship. The sound reflective surface of the article may be planar or non-planar. For non-planar surfaces, the main body portion can be formed with a non-planar configuration such that the convoluted surface matingly engages and conforms with the sound reflective surface. Exemplary articles include vehicles, appliances, machinery, etc. In some embodiments, an acoustic panel apparatus can be bent around a non-planar article and be secured thereto in various ways.

Embodiments of the present invention can provide cost savings over conventional acoustic panels and apparatus as a result of mass reduction while still achieving a required acoustic performance. Embodiments of the present invention are stronger and more durable than conventional acoustic panels, which are typically fragile and/or have poor wear properties. An airflow-resistive layer of material can provide structural integrity and strength to an acoustic panel/apparatus and, thus, can allow the opposite side to have a deeper convoluted configuration, than otherwise possible. In other words, more material can be removed from the convoluted surface (i.e., the troughs and valleys of a convoluted surface can be deeper). Moreover, the addition of an airflow-resistive layer can reduce the overall thickness of an acoustic panel/apparatus because of the added sound attenuation capabilities provided by the airflow-resistive layer of material. As such, acoustic panels/apparatus, according to embodiments of the present invention, can have significant mass reduction (e.g., up to about 50% mass reduction) compared with conventional acoustic panels, which can lead to cost savings for both producers and users. Moreover, embodiments of the present invention are advantageous because, with reduced mass as a result of the use of convoluted surfaces and the use of airflow-resistive layers, they can have a significant weight advantage over non-convoluted absorbers of the same thickness.

Embodiments of the present invention can have increased fire protection capabilities as compared with conventional acoustic panels. Flammability resistant (FR) material may be utilized for the main body portion of an acoustic panel according to some embodiments of the present invention. In addition or alternatively, an FR material and/or coating may be utilized in an airflow-resistive layer of material attached to a main body portion, according to some embodiments. In addition, a binder material may be applied to an airflow-resistive layer of material, according to some embodiments of the present invention, to modify air flow resistance of the material.

It is noted that aspects of the invention described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail below.

BRIEF DESCRIPTION OF THE DRAWINGS

The accompanying drawings, which form a part of the specification, illustrate various embodiments of the present invention. The drawings and description together serve to fully explain embodiments of the present invention.

DETAILED DESCRIPTION

Figure 1:
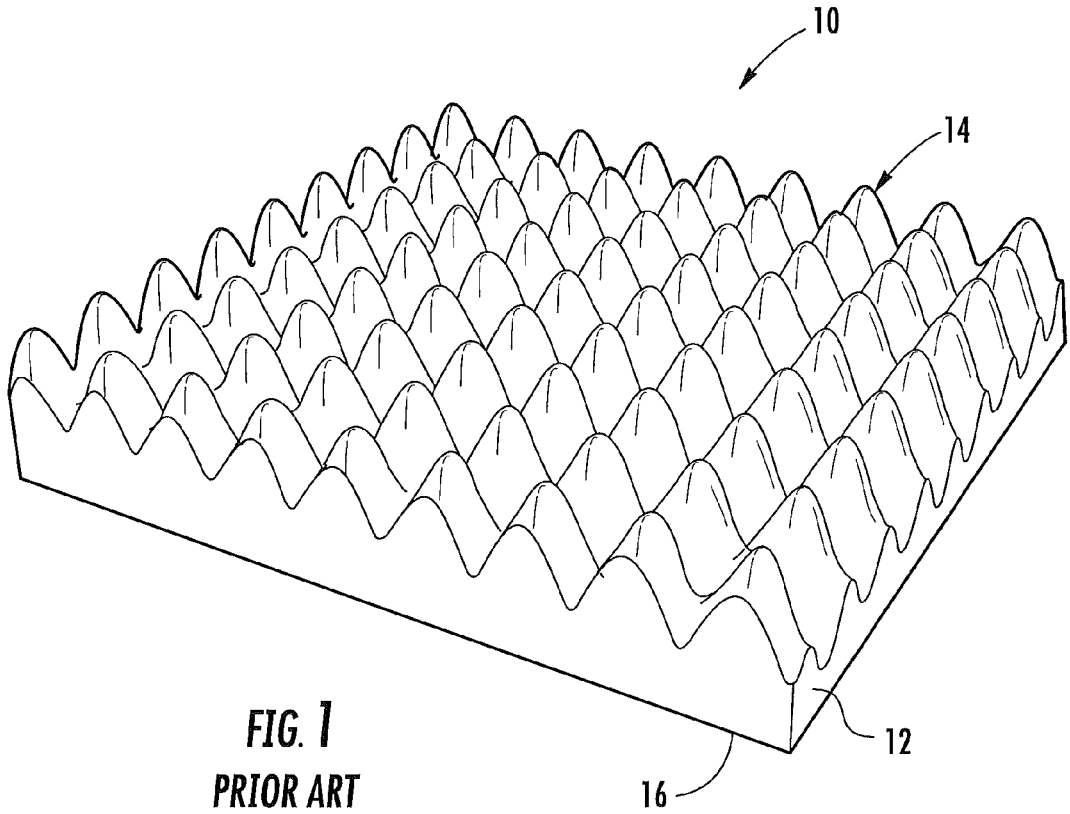
FIG. 1 PRIOR ART
FIG. 1 is a perspective view of a conventional acoustic panel with a convoluted, sound facing surface.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain layers, components or features may be exaggerated for clarity, and broken lines illustrate optional features or operations unless specified otherwise. In addition, the sequence of operations (or steps) is not limited to the order presented in the figures and/or claims unless specifically indicated otherwise. Features described with respect to one figure or embodiment can be associated with another embodiment or figure although not specifically described or shown as such.

It will be understood that when a feature or element is referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

It will be understood that although the terms first and second are used herein to describe various features/elements, these features/elements should not be limited by these terms. These terms are only used to distinguish one feature/element from another feature/element. Thus, a first feature/element discussed below could be termed a second feature/element, and similarly, a second feature/element discussed below could be termed a first feature/element without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

Specific airflow resistance of a material is defined as pressure divided by the velocity of laminar air flowing through the material, and is expressed in units of mks rayls (newton-seconds/meter$^3$). Specific airflow resistance is a measure of how easy it is for air to move through a material. Thus, for fibrous materials, specific airflow resistance depends, at least in part, upon the density of the fibrous material and average fiber diameter. Generally, the heavier the material and the finer the fibers, the higher is specific airflow resistance. Moreover, thicker layers will generally have more specific airflow resistance than thinner layers.

Figure 2:
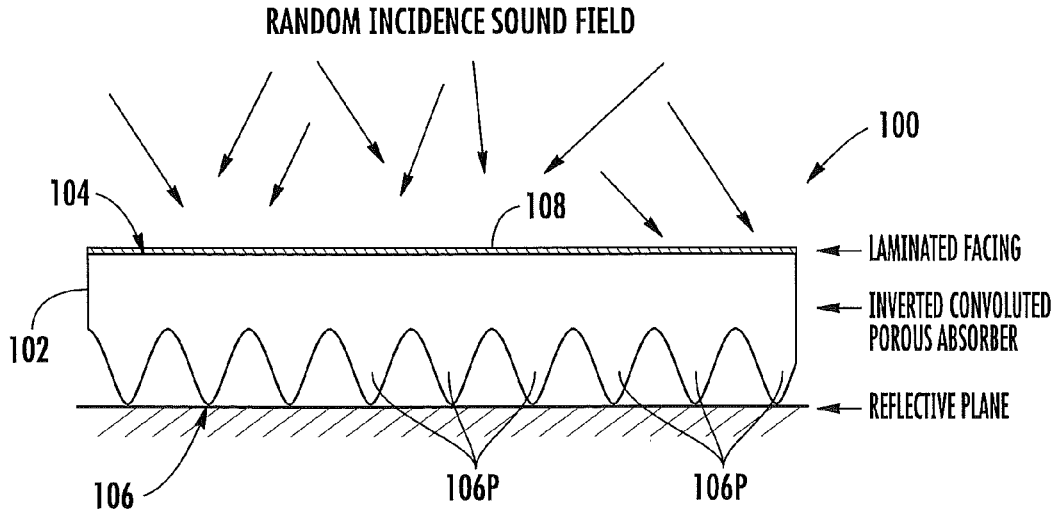
FIG. 2 is a side cross-sectional view of an acoustic panel, according to some embodiments of the present invention.

Referring to FIG. 2, an acoustic panel 100, according to some embodiments of the present invention, is illustrated. The illustrated acoustic panel 100 includes a main body portion 102 having a front surface 104 for orientation toward a sound source and an opposite rear surface 106 for orientation away from a sound source. The front surface 104 is substantially planar, and the rear surface 106 is substantially convoluted. The illustrated acoustic panel 100 is sometimes referred to as a 50% convoluted absorber. An airflow-resistive layer of material 108 is attached to the acoustic panel front surface 104 in face-to-face contacting relationship, as illustrated. In use, the convoluted rear surface 106 is oriented toward a reflective surface 110, such as a wall or ceiling, and away from a sound source. The acoustic panel front surface 104 with the airflow-resistive layer of material 108 laminated thereto is oriented toward the incident sound field, as illustrated.

The main body portion 102 can be formed from various types of porous or semi-porous foams or fibers, either cut or molded to shape. In some embodiments, a fibrous matrix can be formed into a main body portion 102 having a convoluted surface. Exemplary foams that may be utilized include, but are not limited to, open cell, compressible foams, such as polyolefin foams, polyurethane foams, melamine foams, polyimide foams, polyester foams and polyether foams. Foams utilized may range from stiff, inflexible materials to soft thermal formable materials. An exemplary melamine-based open cell foam is Willtec Gray (having a density of about 9.5+/−1.5 kg·m$^3$), available from Pinta Foamtec, Inc., Minneapolis, Minn. Melamine foam, such as Willtec Gray, has strong acoustic absorption and flammability resistance.

In the illustrated embodiment, the acoustic panel rear surface 106 includes rows and columns of sinusoid-shaped protrusions 106*p* arranged in an array. However, the acoustic panel rear surface 106 can have a convoluted configuration formed from any of various shapes arranged in various patterns including, but not limited to, bilateral sinusoidal or near sinusoidal wave shapes, bilateral pyramid shapes, unilateral wedge shapes, alternating ninety degree) (90°) wedge block groups, egg crate patterns, etc. Moreover, the acoustic panel 100 can have various shapes and sizes, without limitation.

The airflow-resistive layer 108 provides structural integrity and strength to the main body portion 102. As a result, the convoluted configuration of the acoustic panel rear surface 106 can be deeper than otherwise would be possible without the airflow-resistive layer 108. In some embodiments, and depending on the type of material of the main body portion, the depth of a convoluted pattern can be as much as about seventy-five percent (75%) of the thickness of the main body portion 102 without affecting the structural integrity of the main body portion 102.

Figure 6A:
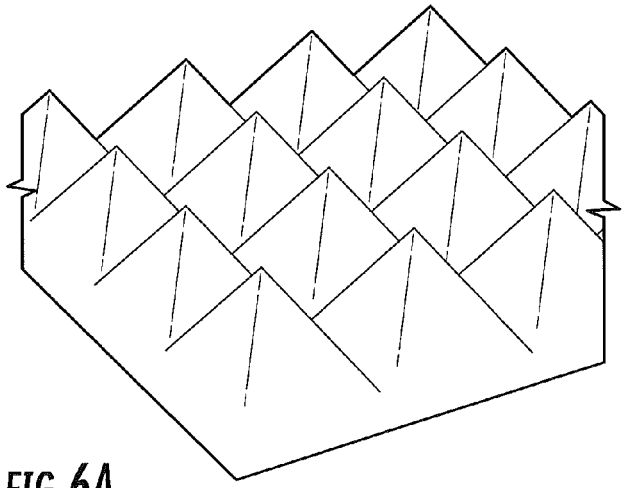
FIGS. 6A-6C are perspective views of respective shapes that may be utilized to create an acoustic panel convoluted surface, according to some embodiments of the present invention.
Figure 6B:
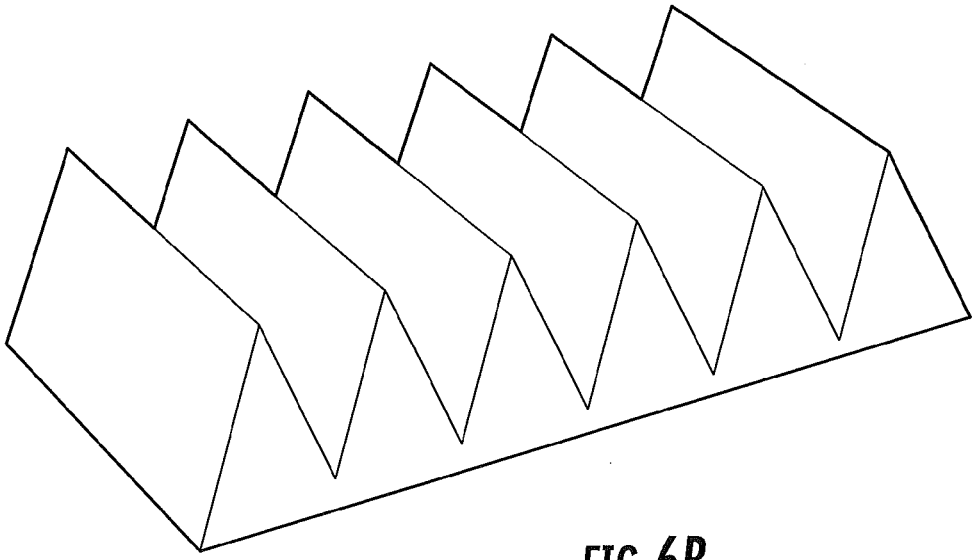
Figure 6C:
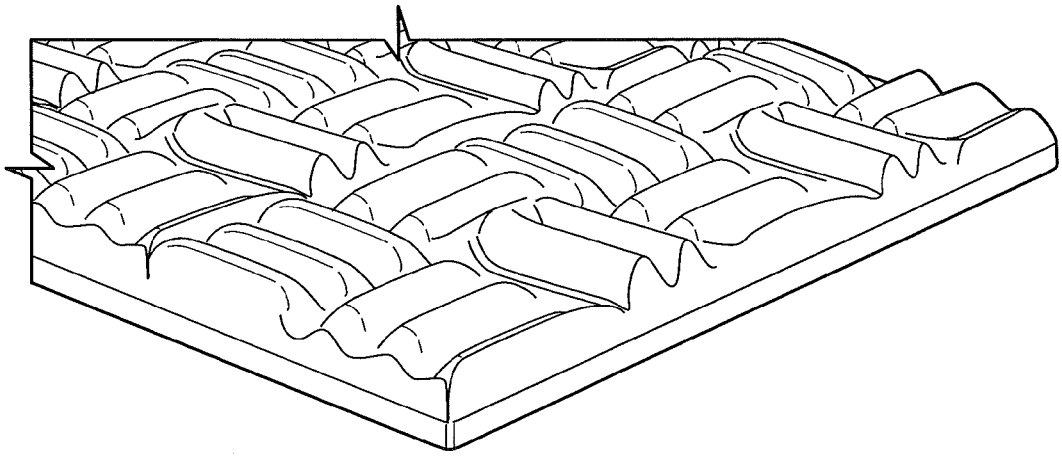

FIGS. 6A-6C illustrate other non-limiting shapes that may be utilized for the main body portion 102 of acoustic panels according to embodiments of the present invention. A pyramid pattern is illustrated in FIG. 6A; a wedge pattern is illustrated in FIG. 6B; and a pattern of elongated patterns is illustrated in FIG. 6C.

The material of the airflow-resistive layer 108 can be any material which provides specific airflow resistance in the range of about 50 to about 20,000 mks rayls. In some embodiments, the airflow-resistive layer of material can be configured (e.g., via thickness, pore size, fiber stiffness, material type, etc.) to attenuate sound at one or more predetermined frequencies. Exemplary materials for the airflow-resistive layer of material 108 include, but are not limited to, all forms of natural fibers, synthetic fibers and blends thereof, either woven or non-woven, perforate films or sheets of any material, and other foam layers.

The material of the airflow-resistive layer 108 can serve multiple functions. Acoustically, the airflow-resistive layer 108 can provide tuned airflow resistance that is matched to the acoustic characteristics of the main body portion 102. Because the airflow-resistive layer 108 defines the outer surface of the acoustic panel 100, the airflow-resistive layer 108 may have a durability function, as well as a cosmetic function. For example, the material can be a durable material that protects the acoustic panel 100 against wear and tear during use. In addition, the airflow-resistive layer can provide strength/reinforcement to the main body portion 102. For example, when mass is removed from the main body portion 102 to form the convoluted surface 106, the structure of the main body portion 102 may become weaker. The added strength/durability of the airflow-resistive layer 108 improves the integrity of the acoustic panel 100 and counteracts any loss of integrity resulting from the convoluted surface 106.

Exemplary film materials that may be utilized as the airflow-resistive layer of material 108 include, but are not limited to, perforated or micro-perforated PE (polyethylene), PET (polyethylene terephthalate), PA (polyamide), PP (polypropylene) and PLA (poly lactic acid). In some embodiments, the airflow-resistive layer of material 108 has air permeability between about 10 cfm and about 75 cfm.

Woven fabrics that may be utilized as the airflow-resistive layer of material 108 are available from Precision Fabrics Group, Inc. Greensboro, N.C. An exemplary woven fabric is PFG Style 60001-060-0000 filament polyester plain weave from Precision Fabrics Group, Inc.

Nonwoven materials that may be utilized as the airflow-resistive layer of material 108 include, but are not limited to, a spunlace nonwoven polyester cellulose blends, SMS (spunbond/meltblown/spunbond) PP (polypropylene) meltblown materials, and continuous filament spunbond fiber blends. An exemplary SMS PP meltblown material is available from First Quality Nonwovens of Great Neck, New York, such as FQN 1.4 oz/yd$^2$ Style 07123. An exemplary continuous filament spunbond fiber blend is available from Freudenberg Nonwovens North America of Durham, N.C., such as Evolon100.

An exemplary spunlace nonwoven polyester cellulose blend is formed by entangling a cellulosic web and a nonwoven web together. Exemplary cellulosic fibers that may be utilized include wood fibers (pulp) such as bleached Kraft, softwood or hardwood, high-yield wood fibers. Other natural fibers include, but are not limited to, bagesse, milkweed, wheat straw, kenaf, jute, hemp, and these natural fibers may be blended with the cellulosic fibers. Any wood fibers that provide a desired air flow resistance may be employed; however, red cedar and spruce pulps are exemplary. The nonwoven web portion may contain randomly oriented fibers or substantially aligned fibers. Exemplary fibers include, but are not limited to, polypropylene, polyethylene, polyethylene terephthalate, polyester, acetate, nylon, poly lactic acid, viscose and acrylic fibers, and blends thereof. Alternatively, performance fibers such as Nomex or Kevlar (DuPont), Kermel (Rhone Poulenc), polybenzimidazole (PBI—Hoechst), Basofil (BASF), polyetheretherketone (PEEK—Zyex Ltd.), Visil (Kuitu Finland Oy), Ultem, Lexan or Valox (GE Plastics) fibers may be used. The staple fiber batt may be made using 1.5 denier 1.5 inch long polyester drawn and crimped fibers which are known to spunlace well. However, other length and denier fibers including microfiber and splittable staple fibers may also be used for the nonwoven portion of the sound absorption substrate to be utilized as an airflow-resistive layer of material 108. Typically, the substrate comprises 20-60 percent by weight cellulosic fibers by weight and 40-80 percent by weight other fibers.

The airflow-resistive layer 108 may be subjected to various finishing processes. In some embodiments, flame retardants may be applied to the airflow-resistive layer 108 in order to impart flame retardant properties, low smoke generation and heat resistant properties and/or to increase the density or modify the air flow resistance of the substrate. Flame retardants which are useful for this invention include durable, semi-durable and nondurable flame retardants, organic and inorganic flame retardants and combinations thereof. Furthermore, functional fillers such as alumina trihydrate, ammonium polyphosphate, compounds containing alkali and alkaline earth metals, borates, ammonium salts, nitrogen containing compounds, phosphates, phosphonates, halogens and sulfamates are useful for finishing and coating the airflow-resistive layer 108. Other types of flame retardants which are of utility in this application include intumescent systems, vapor phase flame retardants and systems, endothermic flame retardants and combinations thereof.

Any water based emulsion or dispersion commonly known as a binder or latex may also be used to modify the air flow resistance of the airflow-resistive layer 108 and to impart additional functional properties to the airflow-resistive layer 108. Acrylic binders, vinyl acrylic binders, vinyl acetate binders, styrene containing binders, butyl containing binders, starch binders and polyvinyl alcohol containing binders are examples of binders that find utility in coating and finishing the airflow-resistive layer 108. The binders may be film forming so as to reduce the air flow resistance of the airflow-resistive layer 108. Also, the binders may be salt tolerant so that they can be used in conjunction with ionic flame retardants.

The airflow-resistive layer of material 108 can also have aesthetic functionality. For example, the airflow-resistive layer of material 108 can have various graphics, colors, patterns, and the like, applied thereto, printed thereon, or formed therein.

The airflow resistive layer of material 108 can be attached to the acoustic panel front surface 104 in various ways. For example, the airflow-resistive layer of material 108 can be laminated to the acoustic panel front surface. Lamination of the airflow-resistive layer of material 108 to the acoustic panel front surface 104 may include the use of adhesives, as would be understood by those skilled in the art.

Figure 3:
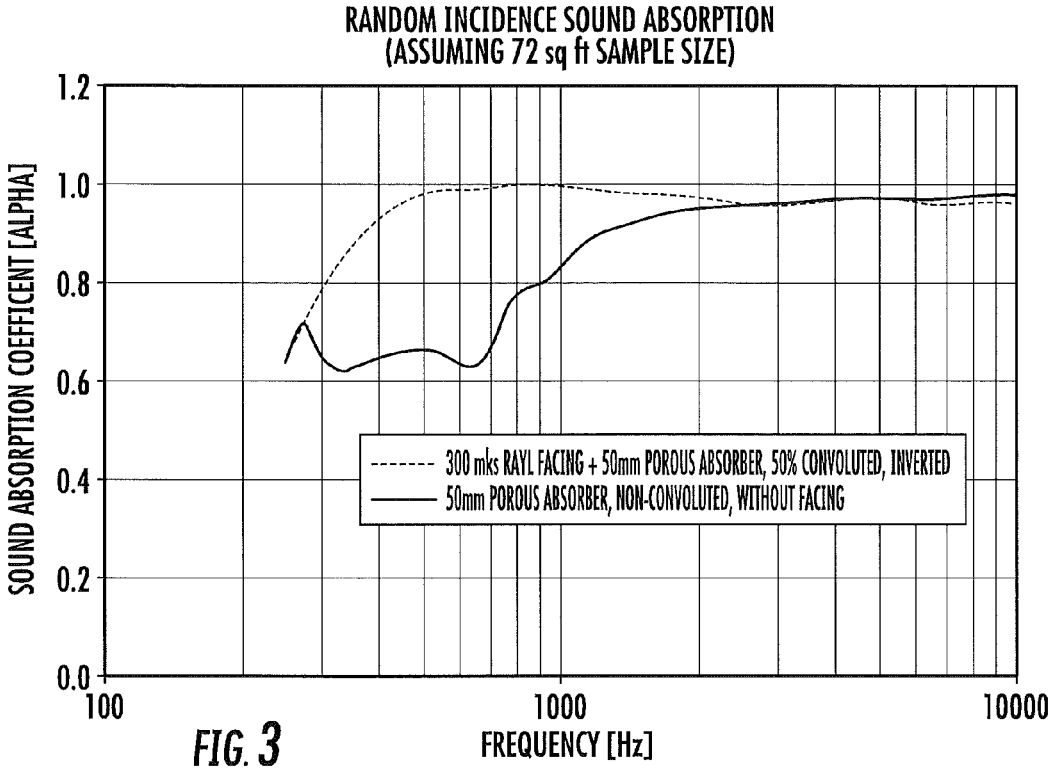
FIGS. 3-5 are graphs that illustrate sound absorption characteristics of sound attenuating panels, according to some embodiments of the present invention, compared with conventional acoustic panels.
Figure 4:
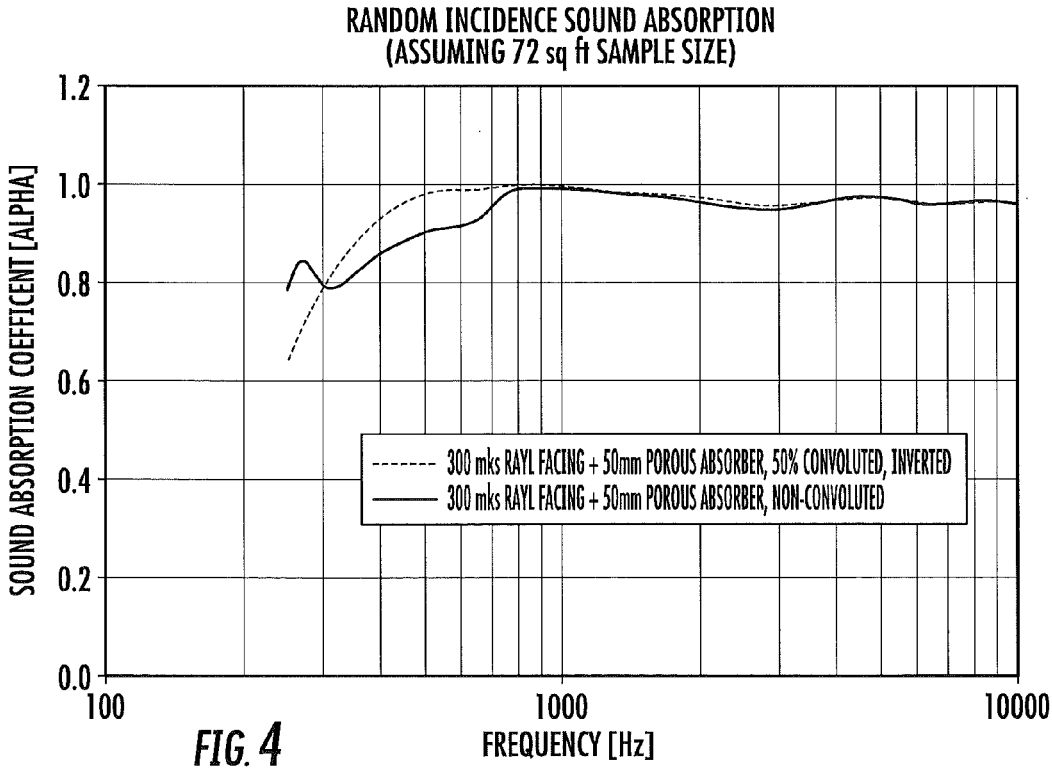
Figure 5:
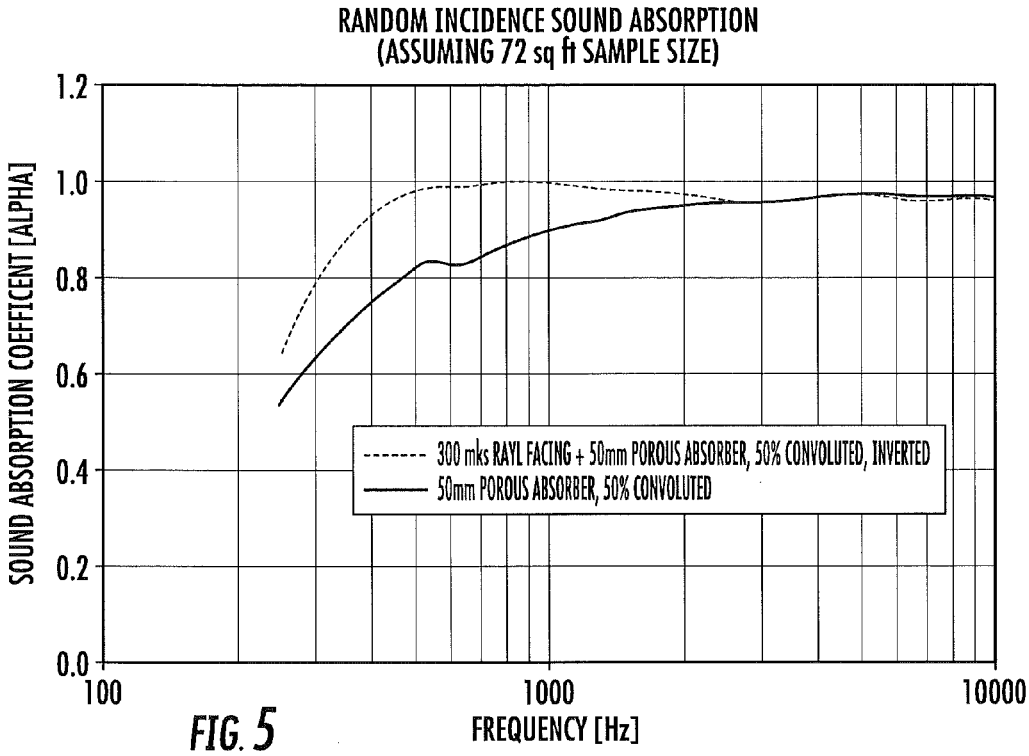

Applicants have unexpectedly found that applying an airflow-resistive layer of material to a planar surface of an acoustic panel having an opposite surface with a convoluted configuration and orienting the acoustic panel such that the surface with the convoluted configuration is facing a reflective surface, such as a wall or ceiling, dramatically increases sound absorption performance of the acoustic panel. FIGS. 3-5 illustrate the improvement of random incidence sound absorption of acoustic panels, according to embodiments of the present invention, as compared with conventional acoustic panels. In the comparisons represented by FIGS. 3-5, all of the acoustic panels have a thickness of about fifty millimeters (50 mm) and are made of the same semi-porous melamine foam base material. The airflow-resistive facing layer utilized is a 300 mks rayl layer.

According to other embodiments of the present invention, an acoustic apparatus may be provided without requiring a separate airflow-resistive layer of material applied to a front surface thereof. For example, a main body portion (e.g., main body portion 102 of FIG. 2) formed from a foam material may have an airflow-resistive layer effectively formed thereon by applying a coating layer of material to the front surface (e.g., front surface 104 of FIG. 2). In other embodiments, a main body portion (e.g., main body portion 102 of FIG. 2) formed from a foam material may have an airflow-resistive layer effectively formed therein as a "skin" layer integral with the front surface thereof (e.g., front surface 104 of FIG. 2). Various methods of forming a skin at the front surface may be utilized, as would be understood by those skilled in the art of foams. For example, in some embodiments a skin of thermoplastic material (e.g., polyester, polyurethane, etc.) can be formed at the front surface via a molding operation. In other embodiments, the surface of a main body portion of compressible foam material may be subjected to heat and/or compression to form a skin layer therein. Such a skin can be designed to have selected airflow resistance and/or can be mechanically perforated to create selected airflow values.

FIG. 3 is a comparison of an acoustic panel 100, according to an embodiment of the present invention, and a flat slab absorber panel (i.e., a foam absorber body with planar front and rear surfaces), each having the same foam material and thickness. The acoustic panel 100 was oriented with the airflow-resistive layer of material 108 facing a sound source. The acoustic panel 100 of the present invention achieved enhanced sound absorption performance in the frequency range of about 275 Hz to about 1100 Hz, as compared with the flat slab absorber panel, as illustrated.

FIG. 4 is a comparison of an acoustic panel 100, according to an embodiment of the present invention, and a flat slab absorber panel (i.e., a foam absorber body with planar front and rear surfaces), each having the same foam material and thickness. The flat slab absorber panel also has the same airflow-resistive layer of material applied to a surface thereof. The acoustic panel 100 and flat slab absorber panel were both oriented such that the respective airflow-resistive layer of material of each was facing a sound source. The acoustic panel 100 of the present invention obtained comparable sound absorption performance with respect to the flat slab absorber panel over most of the frequency range, and obtained enhanced sound absorption performance in the frequency range of about 300 Hz to about 800 Hz, as illustrated.

FIG. 5 is a comparison of an acoustic panel 100, according to an embodiment of the present invention, and an identical acoustic panel that does not have an airflow-resistive layer of material on the planar front surface thereof. Both acoustic panels have the same absorber material and thickness, and both acoustic panels have the same convoluted surface. The acoustic panel 100 was oriented such that the airflow-resistive layer of material was facing a sound source. The other acoustic panel was oriented in the conventional manner with the convoluted surface facing the sound source. As illustrated in FIG. 5, the acoustic panel 100 of the present invention has superior acoustical performance at low and mid frequencies, while maintaining comparable performance at higher frequencies, as compared with a conventional acoustic panel with a convoluted surface oriented in the conventional manner with respect to a sound source. Specifically, the acoustic panel 100 obtained enhanced sound absorption performance in the frequency range of about 250 Hz to about 1150 Hz, as compared with the conventional acoustic panel in the conventional orientation, as illustrated.

Figure 7:
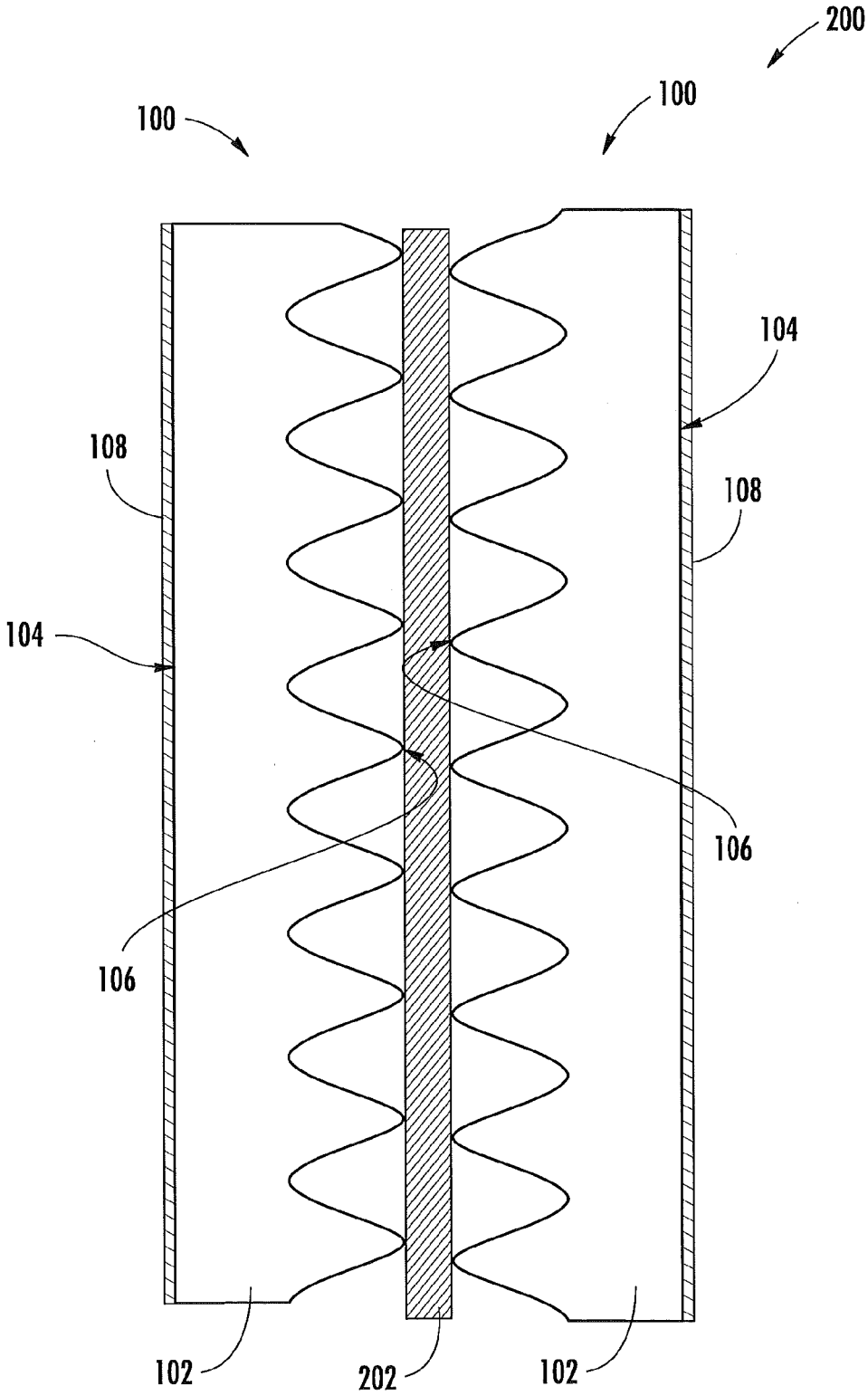
FIG. 7 is a side cross-sectional view of an acoustic panel assembly, according to some embodiments of the present invention.

Referring to FIG. 7, an acoustic panel assembly 200 with enhanced sound absorption performance on both sides thereof, according to other embodiments of the present invention, is illustrated. The illustrated acoustic panel assembly 200 includes first and second acoustic panels 100, each having opposite front and rear surfaces 104, 106. The rear surface 106 of each acoustic Panel 100 has a convoluted configuration, and the front surface 106 is substantially planar. Various types of convoluted configurations can be utilized without limitation. An airflow-resistive layer of material 108 is laminated to the front surface 106 of each acoustic panel 100, as described above. A septum 202 is sandwiched between and attached to the two acoustic panels 100, as illustrated. The septum 202 may be adhesively attached to the convoluted rear surface 106 of each acoustic panel 100. As such, the airflow-resistive layer of material 108 of each acoustic panel 100 is oriented outwardly. The septum 202 may be formed of various materials, including, but not limited to, paperboard, plastic, aluminum, steel and composites thereof. Each acoustic panel 100 can be formed from various types of porous or semi-porous foams or fibers, either cut or molded to shape, as described above.

The septum 202, although primarily intended to serve a structural function, may also provide some tuning (absorption vs. frequency) flexibility. For example, in some embodiments of the present invention, the septum may be designed to absorb sound at low frequencies.

In use, the acoustic panel assembly 200 can be suspended from a ceiling or other structure within a space containing acoustical energy. The acoustic panel assembly 200 can be mounted to a wall or other structure of a given open or enclosed space in such a way as to expose both sides to acoustical energy. Multiple acoustic panel assemblies can be utilized, as would be understood by those skilled in the art. The acoustic panel assembly 200 can have various shapes and sizes, without limitation.

Acoustic panels/apparatus 100 and acoustic panel assemblies 200, according to embodiments of the present invention, can be formed into various products for use in various applications in addition to the conventional use as sound absorbers within a room or other enclosure. For example, acoustic panels and assemblies, according to embodiments of the present invention, can be used in various vehicle applications to reduce external noises, such as road noise, engine noise, vibrations, etc., as well as noises emanating from within passenger compartments. Exemplary road vehicle locations in which embodiments of the present invention may be utilized include, but are not limited to, dashboards, wheel wells, trunk compartments, and under hoods. Embodiments of the present invention can also be used in transportation applications involving other vehicles including, but not limited to, aircraft, railroad cars, boats, and the like. Because acoustic panels/products/assemblies according to the present invention can offer enhanced sound attenuation with reduced weight, as compared with conventional sound attenuating materials, fuel efficiency for transportation vehicles can be enhanced.

Acoustic panels/apparatus 100 and acoustic panel assemblies 200, according to embodiments of the present invention, can be used in various devices and machinery to attenuate noise. For example, appliances, such as dishwashers, can incorporate acoustic panels/apparatus 100 and assemblies 200 to attenuate noise emanating from the appliances. In the case of a dishwasher, an acoustic panel 100 or assembly 200 can be formed or bent around the internal tub.

Embodiments of the present invention are not limited to just having conventional acoustic panel shapes. Embodiments of the present invention can be utilized in all types of uses where sound attenuation is desirable. Acoustic panels and apparatus, according to embodiments of the present invention, can have various "non-panel", three-dimensional shapes. In addition, various molded foam parts having an airflow-resistive layer of material attached to a surface thereof can be utilized, as well.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

That which is claimed is:

1. An acoustic panel, comprising:

a main body portion having a front surface for orientation toward a sound source and an opposite rear surface, wherein the front surface is substantially planar, wherein the rear surface is substantially convoluted, and wherein the front surface comprises an airflow-resistive skin layer integrally formed therein via heat and/or compression, wherein the airflow-resistive skin layer has a density greater than a density of the main body portion, and wherein the airflow-resistive skin layer is configured to attenuate sound at one or more predetermined frequencies.

2. The acoustic panel of claim 1, wherein the airflow-resistive skin layer has a specific airflow resistance of between about 50-20,000 mks rayls.

3. The acoustic panel of claim 1, wherein a depth of convolution of the rear surface is between about forty percent to about seventy-five percent (40%-75%) of a thickness of the main body portion.

4. The acoustic panel of claim 1, wherein the airflow-resistive skin layer is configured to attenuate sound at one or more predetermined frequencies.

5. The acoustic panel of claim 1, wherein the airflow-resistive skin layer comprises a flame retardant finish.

6. The acoustic panel of claim 1, wherein the main body portion comprises an open cell, compressible foam.

7. The acoustic panel of claim 6, wherein the foam is selected from the group consisting of polyolefin foams, polyurethane foams, melamine foams, polyimide foams, polyester foams and polyether foams.

8. An acoustic panel in combination with a structure, the structure having a sound reflective surface, the combination comprising:

a main body portion having a front surface for orientation toward a sound source and an opposite rear surface contacting the sound reflective surface, wherein the front surface is substantially planar, and wherein the rear surface is substantially convoluted; and an airflow-resistive layer of material secured to the front surface in face-to-face contacting relationship.

9. An acoustic apparatus in combination with an article, the article comprising a sound reflective surface, the combination comprising:

a main body portion having a front surface for orientation toward a sound source and an opposite rear surface contacting the sound reflective surface, wherein the main body portion rear surface is substantially convoluted; and an airflow-resistive layer of material secured to the front surface in face-to-face contacting relationship.

10. The combination of claim 9, wherein the sound reflective surface is non-planar, and wherein the main body portion front surface has a non-planar configuration that conforms with the sound reflective surface.

11. The combination of claim 9, wherein the article is a vehicle.

12. The combination of claim 9, wherein the article is an appliance.

13. The combination of claim 9, wherein the article is a machine.

14. An acoustic panel assembly, comprising:

a first main body portion having a substantially planar front surface for orientation toward a sound source and an opposite, substantially convoluted rear surface, wherein the front surface comprises a first airflow-resistive skin layer integrally formed therein via heat and/or compression, wherein the first airflow-resistive skin layer has a density greater than a density of the first main body portion, and wherein the first airflow-resistive skin layer is configured to attenuate sound at one or more predetermined frequencies;

a second main body portion having a substantially planar front surface for orientation toward a sound source and an opposite, substantially convoluted rear surface, wherein the front surface comprises a second airflow-resistive skin layer integrally formed therein via heat and/or compression, wherein the second airflow-resistive skin layer has a density greater than a density of the second main body portion, and wherein the second airflow-resistive skin layer is configured to attenuate sound at one or more predetermined frequencies;

and a septum sandwiched between the first and second main body portions such that the rear surfaces of the first and second main body portions are in contacting relationship with the septum.

15. The acoustic panel assembly of claim 14, wherein the septum comprises paperboard, plastic, aluminum, steel or composites thereof.

16. The acoustic panel assembly of claim 14, wherein the first and second airflow-resistive skin layers have a specific airflow resistance of between about 50-20,000 mks rayls.

17. The acoustic panel assembly of claim 14, wherein the first and second airflow-resistive skin layers are configured to attenuate sound at one or more predetermined frequencies.

18. The acoustic panel assembly of claim 14, wherein the first and second main body portions comprise open cell, compressible foam.

19. The acoustic panel assembly of claim 18, wherein the foam is selected from the group consisting of polyolefin foams, polyurethane foams, melamine foams, polyimide foams, polyester foams and polyether foams.

* * * * *